US010251218B2

(12) United States Patent
Gomez et al.

(10) Patent No.: US 10,251,218 B2
(45) Date of Patent: Apr. 2, 2019

(54) APPLIANCE HEATING ELEMENT

(71) Applicant: General Electric Company, Schenectady, NY (US)

(72) Inventors: Eugenio Gomez, Louisville, KY (US); James Lee Armstrong, Louisville, KY (US); Joshua Stephen Wiseman, Elizabethtown, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 198 days.

(21) Appl. No.: 14/696,536

(22) Filed: Apr. 27, 2015

(65) Prior Publication Data

US 2016/0316519 A1 Oct. 27, 2016

(51) Int. Cl.

| | |
|---|---|
| ***H05B 3/74*** | (2006.01) |
| ***H05B 1/02*** | (2006.01) |
| ***H05B 3/12*** | (2006.01) |
| ***H05B 3/14*** | (2006.01) |
| ***H05B 3/48*** | (2006.01) |
| *F24C 15/10* | (2006.01) |

(52) U.S. Cl.

CPC ..... *H05B 3/746* (2013.01); *H05B 1/0266* (2013.01); *H05B 3/12* (2013.01); *H05B 3/141* (2013.01); *H05B 3/48* (2013.01); *F24C 15/102* (2013.01); *H05B 2203/02* (2013.01); *H05B 2213/07* (2013.01)

(58) Field of Classification Search

CPC ..... H05B 3/746; H05B 3/12; H05B 3/141; H05B 3/48; H05B 1/0266; H05B 2203/02; H05B 2203/07; F24C 15/102

See application file for complete search history.

(56) References Cited

U.S. PATENT DOCUMENTS

| | | | | |
|---|---|---|---|---|
| 2,686,250 A * | 8/1954 | Schroeder | H05B 1/0266 219/433 |
| 3,761,680 A * | 9/1973 | Ingrao | F24C 15/102 219/453.11 |
| 4,245,146 A | 1/1981 | Shioi et al. | |
| 5,866,879 A * | 2/1999 | Higgins | F24C 15/106 219/457.1 |
| 6,150,636 A * | 11/2000 | Bogdanski | A47J 27/002 219/443.1 |
| 6,875,957 B2 | 4/2005 | Taplan et al. | |

(Continued)

FOREIGN PATENT DOCUMENTS

| | | |
|---|---|---|
| CN | 203263098 | 11/2013 |
| EP | 0384640 | 8/1990 |

OTHER PUBLICATIONS

Abstract of CN203195493 dated Sep. 18, 2013, 1 page.

*Primary Examiner* — Shawntina T Fuqua
(74) *Attorney, Agent, or Firm* — Dority & Manning, P.A.

(57) ABSTRACT

A heating element that limits the maximum temperature readied by a cooking utensil or food items placed on the heating element is provided. A cooktop appliance with features for limiting the maximum temperature reached by a cooking utensil or food items placed on a heating element of the cooktop appliance also is provided. In particular, a cooktop appliance with a positive temperature coefficient heating element and a controller for regulating the heating element to a selected temperature or heat output is provided.

20 Claims, 4 Drawing Sheets

(56) References Cited

U.S. PATENT DOCUMENTS

| | | | | |
|---|---|---|---|---|
| 6,919,542 | B2 * | 7/2005 | Galliou | H05B 3/48 219/468.2 |
| 2009/0272728 | A1 * | 11/2009 | Abbott | F24C 7/04 219/399 |
| 2013/0112681 | A1 | 5/2013 | Kim et al. | |

* cited by examiner

APPLIANCE HEATING ELEMENT

FIELD OF THE INVENTION

The subject matter of the present disclosure relates generally to cooktop appliances, in particular heating elements for cooktop appliances.

BACKGROUND OF THE INVENTION

Cooktop appliances, such as, e.g., cooktop range or oven range appliances, generally include one or more heated portions for heating or cooking food items within a cooking utensil placed on the heated portion. The heated portions utilize one or more heating elements to output heat, which is transferred to the cooking utensil and food item or items within the cooking utensil. Typically, a controller or other control mechanism regulates the temperature of or the heat output by the heating element to a temperature or a heat output selected by a user of the cooktop appliance. For example, the controller may cycle the heating element between an activated, or on, state and a deactivated, or off, state such that the average temperature or heat output over each on/off cycle approximates the selected temperature or heat output.

However, the transfer of heat to the cooking utensil and/or food items may cause the food items or cooking utensil to overheat or may otherwise cause unwanted or unsafe conditions of the cooktop. Although additional components such as, e.g., sensors, relays, electronic controls, and/or thermal switches could be used to limit the transfer of heat to the cooking utensil and/or food item, additional components would increase the cost of the cooktop appliance. Further, adding components could negatively impact the manufacturability and interfere with the cooking performance of the cooktop.

Accordingly, a cooktop appliance with features for limiting the maximum temperature reached by a cooking utensil or food items placed in thermal contact with a heating element of the cooktop appliance would be useful. A heating element that limits the maximum temperature reached by a cooking utensil or food items placed in thermal contact with the heating element would be beneficial.

BRIEF DESCRIPTION OF THE INVENTION

The present invention provides a heating element that limits the maximum temperature reached by a cooking utensil or food items placed in thermal contact with the heating element. A cooktop appliance with features for limiting the maximum temperature reached by a cooking utensil or food items placed in thermal contact with a heating element of the cooktop appliance also is provided. In particular, a cooktop appliance with a positive temperature coefficient heating element is provided. Additional aspects and advantages of the invention will be set forth in part in the following description, may be apparent from the description, or may be learned through practice of the invention.

In a first exemplary embodiment, a heating assembly for a cooktop appliance is provided. The heating assembly is configured for placement of a cooking utensil thereon. The heating assembly includes a sheath, an insulating material, and a positive temperature coefficient heating element. The positive temperature coefficient heating element regulates the temperature of the heating assembly such that the temperature of the cooking utensil placed on the heating assembly does not exceed a maximum temperature.

In a second exemplary embodiment, a cooktop appliance is provided. The cooktop appliance comprises a heating assembly that includes a sheath, an insulating material, and a positive temperature coefficient heating element. The cooktop appliance further comprises a controller in operative communication with the heating element. The controller controls a temperature of the heating element based on a selection by a user of the cooktop appliance. The positive temperature coefficient heating element regulates the temperature of the heating assembly such that the temperature of a cooking utensil placed on the heating assembly does not exceed a maximum temperature.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same reference numerals in different figures denotes the same or similar features.

DETAILED DESCRIPTION OF THE INVENTION

Figure 1:
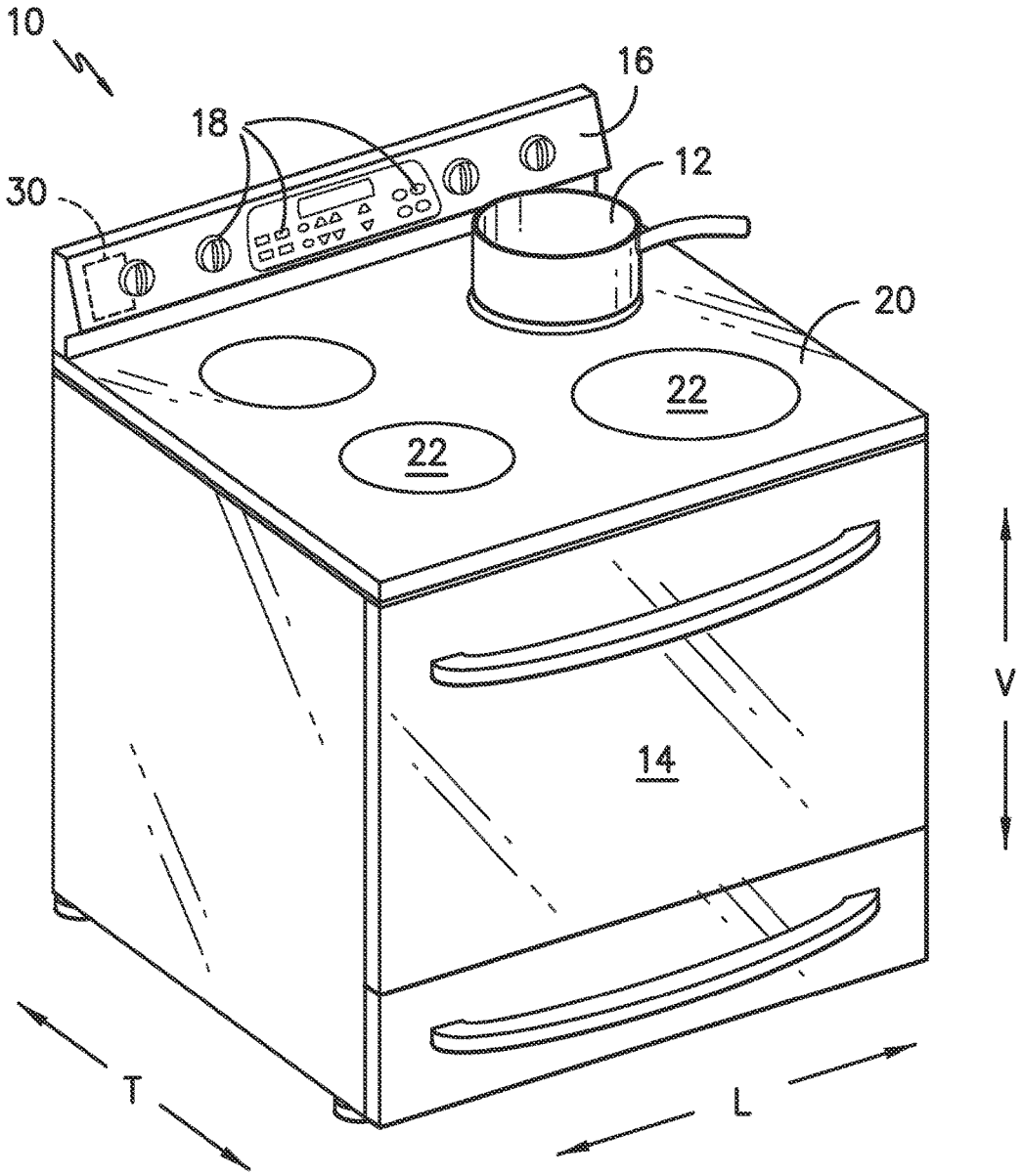
FIG. 1 provides a side, perspective view of a cooktop or oven range appliance according to the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a cooktop or oven range appliance 10. Cooktop appliance 10 is provided by way of example only and is not intended to limit the present subject matter in any aspect. Thus, the present subject matter may be used with other cooktop appliance configurations, e.g., cooktop range appliances without an oven. Further, the present subject matter may be used in any other suitable appliance.

Figure 3:
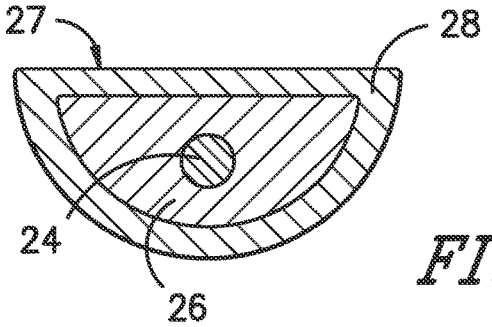
FIG. 3 provides a cross-sectional view of a portion of the heating assembly of FIG. 2.

Cooking surface 20 of cooktop appliance 10 includes heated portions comprising heating assemblies 22 that may be heated by heating elements 24 (FIG. 3). In some embodiments, cooktop appliance 10 may be a radiant cooktop appliance, and cooking surface 20 may be constructed of a glass, ceramic, or a combination glass-ceramic material, or any other suitable material. Heating elements 24 may be, e.g., electrical resistive heating elements and/or any other suitable heating element. Each heating assembly 22 of cooktop 10 may be heated by the same type of heating element 24, or cooktop 10 may include a combination of different types of heating elements 24. Further, heating assemblies 22 may have any suitable shape and size, and a combination of heating assemblies of different shapes and sizes may be used.

As shown in FIG. 1, a cooking utensil 12, such as a pot, pan, or the like, may be placed on a heating assembly 22 to cook or heat food items placed in the cooking utensil. Oven range or cooktop appliance 10 also includes a door 14 that permits access to a cooking chamber (not shown) of appliance 10, e.g., for cooking or baking of food items therein. A control panel 16 having controls 18 permits a user to make selections for cooking of food items; although shown on a backsplash or back panel of cooktop 10, control panel 16 may be positioned in any suitable location. Controls 18 may include buttons, knobs, and the like, as well as combinations thereof. As an example, a user may manipulate one or more controls 18 to select a temperature and/or a heat or power output for each heating assembly 22. The selected temperature or heat output of heating assembly 22 affects the heat transferred to cooking utensil 12 placed on heating assembly 22, as further described below.

The operation of cooktop appliance 10, including heating elements 24, may be controlled by a processing device such as a controller 30 (FIG. 1), which may include a microprocessor or other device that is in operative communication with components of appliance 10. Controller 30 may include a memory and microprocessor, such as a general or special purpose microprocessor operable to execute programming instructions or micro-control code associated with a cleaning cycle. The memory may represent random access memory such as DRAM, and/or read only memory such as ROM or FLASH. In one embodiment, the processor executes programming instructions stored in memory. The memory may be a separate component from the processor or may be included onboard within the processor. Alternatively, controller 30 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Controls 18 and other components of cooktop appliance 10 may be in communication with controller 30 via one or more signal lines or shared communication busses.

As stated, controller 30 may be in operative communication with various components of cooktop appliance 10, e.g., heating elements 24 and controls 18 such that, in response to user manipulation of controls 18, controller 30 operates the various components of cooktop appliance 10 to execute selected cycles and features. Controller 30 may also be in communication with a temperature sensor (not shown) used to measure the temperature of heating assembly 22 and provide such measurements to controller 30. Using the measurements provided by the temperature sensor, controller 30 may control the temperature of heating element 24 to regulate the temperature or heat output of heating assembly 22 to temperate or heat output selected by the user. For example, using the temperature measurements, controller 30 may cycle heating element 24 between an activated state and a deactivated state, i.e., between on and off, such that the average temperature or heat output over each cycle approximates the selected temperature or heat output. That is, controller 30 may control the duty cycle of heating element 24 such that, based on the user's selection, controller 30 activates or turns on heating element 24 for a fraction or portion of the duty cycle and deactivates or turns off heating element 24 for the remainder of the duty cycle.

In some embodiments, instead of a microprocessor, controller 30 may be a mechanical switch or other mechanical device that controls the temperature or heat output of heating element 24. For example, controller 30 may be a bimetal infinite switch that controls the duty cycle of heating element 24, e.g., by opening or closing to regulate the amount of time heating element 24 is on during the duty cycle. More specifically, a user of cooktop 10 may, e.g., manipulate a control 18 associated with a heating assembly 22 to select a desired heat output or temperature for heating element 24 of the associated heating assembly 22. The selection by the user indicates to controller 30 what fraction or portion of the duty cycle heating element 24 should be activated or on, e.g., if the user selects the midpoint heat output or temperature, controller 30 may control the duty cycle of heating element 24 such that heating element 24 is on for half of the duty cycle and off for half of the duty cycle. Controller 30 may have other constructions or configurations and may control the temperature and/or heat output of heating element 24 in other ways as well.

Figure 2:
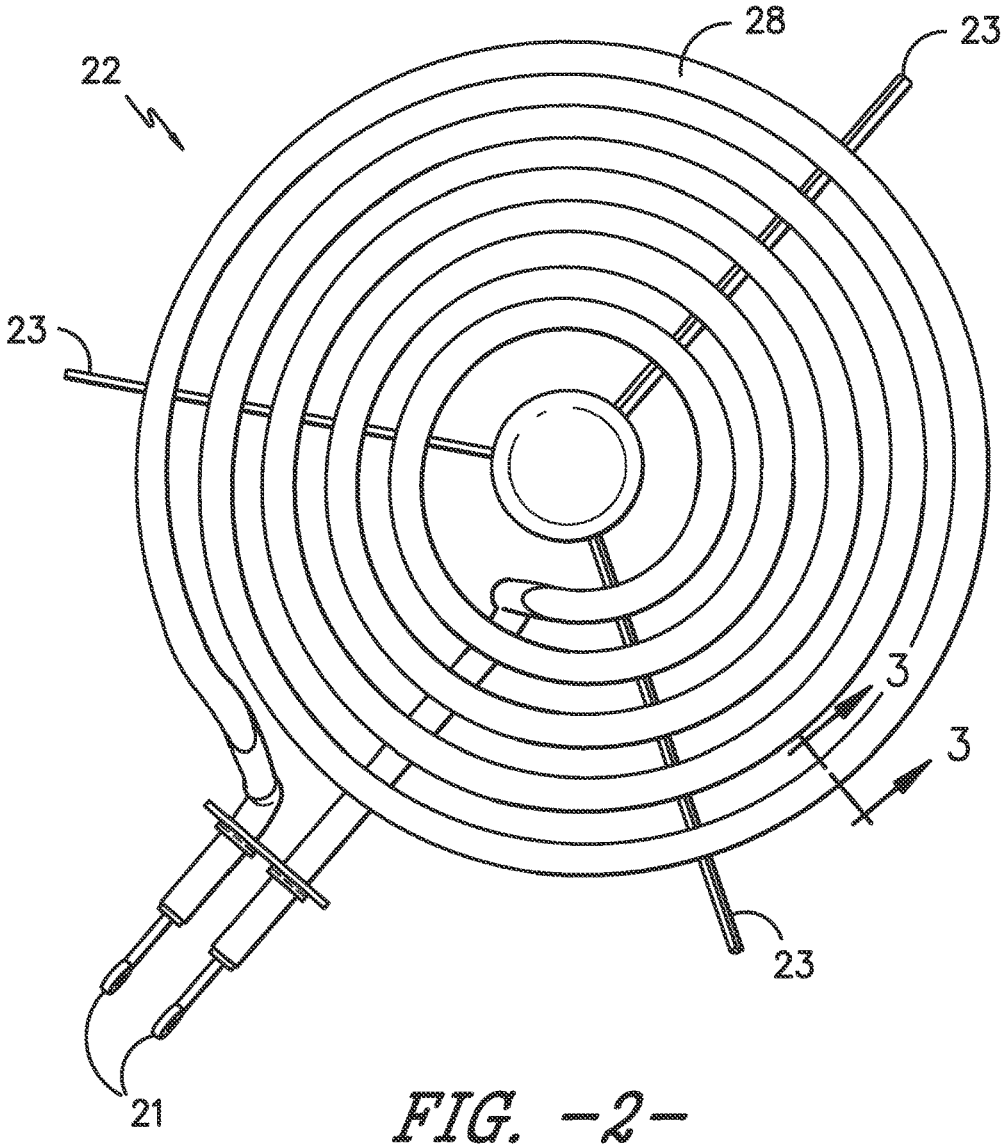
FIG. 2 provides a top view of a heating assembly according to an exemplary embodiment of the present subject matter.

FIG. 2 provides a top view of an exemplary heating assembly 22. In the illustrated exemplary embodiment, heating assembly 22 is a coil shaped electrical resistive heating assembly; that is, FIG. 2 illustrates a heating assembly for a coil cooktop in which cooking utensils 12 are placed directly on heating assembly 22. As shown, heating assembly 22 has two terminals 21. Terminals 21 provide power, i.e., a voltage V, from a power source (not shown) to heating assembly 22, more specifically to heating element 24. Also as shown, heating assembly 22 may be supported on one or more support elements 23. Further, although illustrated as forming a coil shape by winding approximately five times around a centerpoint, heating assembly 22 may have other shapes or configurations as well.

FIG. 3 provides a cross-section view of a portion of heating assembly 22 shown in FIG. 2. As illustrated, heating assembly 22 may have a generally semi-circular cross-section, with a substantially flat surface 27 for supporting a cooking utensil 12 placed on heating assembly 22. Moreover, in the exemplary embodiment of FIG. 3, heating element 24 is surrounded by an insulating material 26, and insulating material 26 is surrounded by a sheath 28. In one exemplary embodiment, insulating material 26 may be magnesium oxide, but other insulating materials also may be used. Further, in some embodiments, sheath 28 may be made from an alloy such as, e.g., Inconel® produced by the Special Metals Corporation of Huntington, W. Va. In other embodiments, sheath 28 may be made from any suitable material. Although shown in FIG. 3 with only one heating element 24, in other embodiments, heating assembly 22 may include any appropriate number of heating elements 24. Additionally, heating assembly 22 may have other cross-sectional shapes or configurations.

Figure 4:
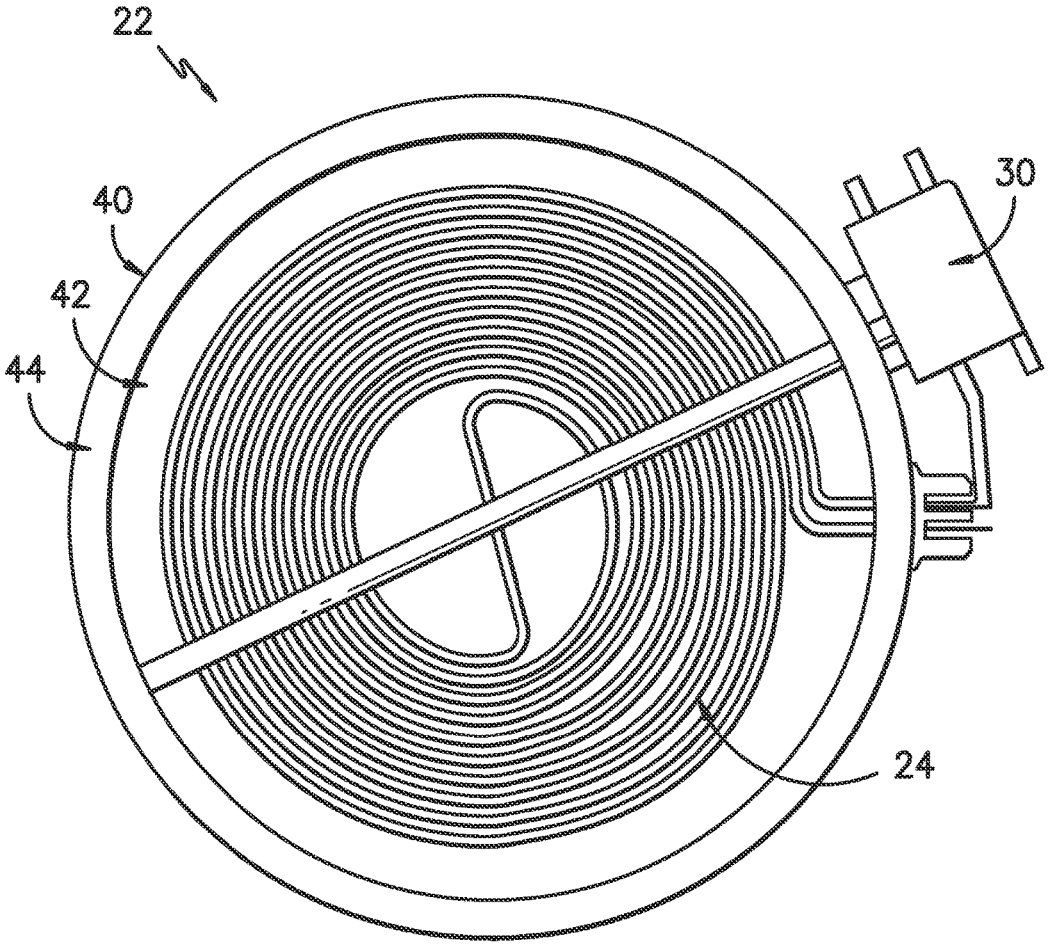
FIG. 4 provides a top view of a heating assembly according to another exemplary embodiment of the present subject matter.

Referring now to FIG. 4, in some embodiments, cooktop appliance 10 may be a radiant cooktop or radiant cooktop range appliance having heating assemblies 22 that are positioned under cooking surface 20 such that cooking utensils 12 are placed on cooking surface 20 rather than directly on heating assemblies 22. Similar to the coil cooktop heating assembly illustrated in FIG. 2, heating assemblies 22 used in radiant cooktop appliances 10 may also include heating elements 24, which may be ribbon heating elements or any other suitable heating element. That is, heating element 24 may be formed as a generally flat ribbon that may be bent or folded to increase the length or amount of heating element ribbon within heating assembly 22. As shown in the illustrated exemplary embodiment, heating element 24 is supported by an insulation pad 42, which is made from an appropriate insulating material such as, e.g., a ceramic material. In some embodiments, heating element 24 may be embedded in insulation pad 42 such that heating element 24 is at least partially surrounded by the insulating material of pad 42. Heating element 24 and insulation pad 42 may be contained or positioned within a dish 40, which may be made from a metal or other appropriate material. Heating assembly 22 also includes an insulation ring 44 vertically spaced apart from heating element 24 and positioned between insulation pad 42 and dish 40. Insulation ring 44 may be positioned against or adjacent cooking surface 20 when heating assembly is installed in appliance 10. As further illustrated in FIG. 4, a controller 30 may be provided with heating assembly 22 to control the temperature and/or heat output of heating assembly 22 based on, e.g., a selection by a user of cooktop appliance 10.

It will be readily understood that the voltage provided to heating element 24 typically is constant, such that the power or heat output by heating element 24 depends on the resistance R of heating element 24. In particular, as voltage V is provided to heating element 24, current I passes through heating element 24 and causes heating element 24 to heat up, or output power P. The heat is then conducted through insulating material 26 and sheath 28 to cooking utensil 12 placed on heating assembly 22, thereby heating cooking utensil 12 and any food items therein.

In traditional heating assemblies, heating element 24 is made from a material having a constant resistance R, e.g., a nichrome wire. In such assemblies, as constant voltage V is provided to heating element 24 having constant resistance R, heating element 24 outputs a constant power P, as represented by the following formulae:

$$P=V*I$$

$$I=V/R$$

Thus, in a traditional heating assembly, when a user selects the highest temperature or heat output setting, heating element 24 outputs a constant maximum power P, thereby delivering the maximum heat to cooking utensil 12 and any food items placed therein. Delivering a constant maximum heat or power to cooking utensil 12 and/or food items therein would cause a temperature $T_{cook}$ of cooking utensil 12 and/or the food items to continually rise. As a result, cooking utensil 12 and/or the food items could overheat, which could lead to undesirable and/or unsafe conditions for the user such as, e.g., smoking and/or a fire.

In contrast, a heating element 24 made from a material having a positive temperature coefficient ("PTC") can reduce the power output of heating element 24 as the temperature of heating element 24 approaches a maximum acceptable temperature. More specifically, a PTC heating element 24 does not have a constant electrical resistance R. Rather, as current passes through PTC heating element 24 and the temperature of heating element 24 rises, the resistance R of PTC heating element 24 increases, thereby decreasing the current passing through and, correspondingly, the power output P heating element 24.

PTC heating element 24 may be made from a resistive heating wire or ribbon having PTC characteristics. Such positive temperature coefficient characteristics include a temperature coefficient of resistance C and temperature factors of resistivity F, which determine the resistance of the PTC heating element at a temperature T according to the following formulae:

$$R(T)=R_{ref}(1+C(T-T_{ref})$$

$$R(T)=F(T)*R_{ref}$$

$$R_{ref}=\frac{V^2}{P_{desired}}$$

where $P_{desired}$ is the desired power output of the PTC wire at room temperature, i.e., 25° C. Accordingly, the power output P of PTC heating element 24 at a temperature T may be calculated using the following formula:

$$P(T)=\frac{V^2}{R(T)}$$

Figure 5:
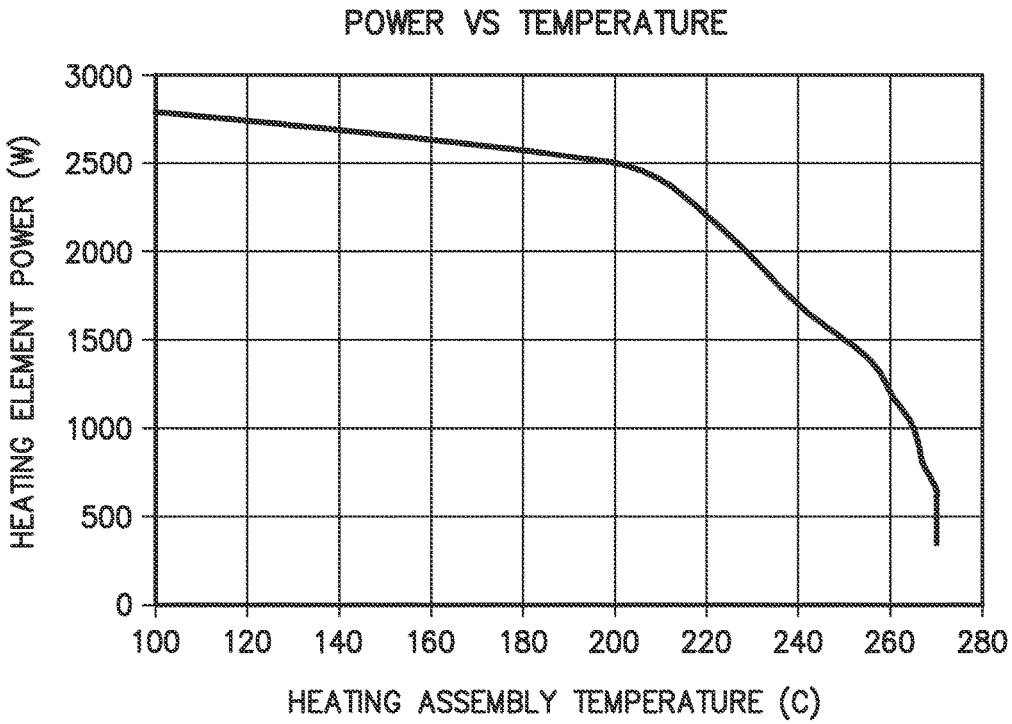
FIG. 5 provides a plot of heating assembly temperature (° C.) versus heating element power (W) according to an exemplary embodiment of the present subject matter.

As can be seen from the foregoing formulae, the resistance R(T) PTC heating element 24 increases as the temperature T of PTC heating element 24 increases, and correspondingly, the power output P(T) of PTC heating element 24 decreases as temperature T increases. Conversely, as temperature T of PTC heating element 24 decreases—e.g., if a relatively cool cooking utensil 12 is placed on heating assembly 22 or if a relatively cool food item is placed within cooking utensil 12 placed on heating assembly 22—the resistance R(T) of PTC heating element 24 decreases and power output P(T) increases to heat the cooking utensil and/or food item. Most cooking occurs at a temperature T of cooking utensil 12 of about 300° C. or less. Heating cooking utensil 12 above about 400° C. could overheat cooking utensil 12 and any food items therein, which could lead to undesirable results as described. Thus, PTC heating element 24 should be made from a material with PTC characteristics that limit a maximum temperature $T_{max}$ of cooking utensil 12 to greater than about 300° C. but less than about 400° C. As shown in FIG. 5, a plot of heating assembly temperature (° C.) versus heating element power (W) illustrates the beneficial effects of an exemplary PTC heating element. More particularly, the graph of FIG. 5 illustrates PTC heating element 24 may function as a passive temperature limiting device, preventing the constant addition of heat or power to items placed on heating assembly 22 when the temperature of such items exceeds a maximum cooking temperature.

As an example, PTC heating element 24 may have a temperature coefficient of resistivity C greater than about 0.001 [1/° C.] to limit temperature $T_{max}$ of cooking utensil 12 to prevent overheating. In one embodiment of PTC heating element 24 having a temperature coefficient of resistivity C within this range, PTC heating element 24 may be made from Kanthal brand Nickel 205 wire or ribbon produced by Sandvik Materials Technology of Sweden. Similarly, PTC heating element 24 may have a temperature factor of resistivity F greater than about 1.4 at temperatures above 300° C. to limit temperature $T_{max}$ of cooking utensil 12 to prevent overheating. In an exemplary embodiment of such a PTC heating element, PTC heating element 24 may be made from Kanthal brand Nifethal 70 wire or ribbon.

Other materials having other temperature coefficients of resistivity C and/or temperature factors of resistivity F may be used as well. Factors such as, e.g., the power rating or output of the PTC heating element at room temperature, the selected insulating material 26, and the selected material for sheath 28 affect the desired temperature coefficient of resistivity C and temperature factor of resistivity F. Generally, materials having a Nickel content of greater than about 10% of the total material composition are suitable materials for PTC heating element 24. In other embodiments, a semiconductor material such as, e.g., barium titanate, or another ceramic material having PTC characteristics may be used for PTC heating element 24.

Therefore, as described herein, heating assembly 22 may be constructed using a PTC heating element 24, which may be surrounded by insulating material 26 that is, in turn, surrounded by sheath 28. Because the resistance of PTC heating element 24 increases as the temperature of PTC heating element 24 increases, PTC heating element 24 regulates the temperature of the heating assembly such that the temperature of cooking utensil 12 placed on heating assembly 22, and/or food items within utensil 12, does not exceed a maximum temperature. By limiting the maximum temperature $T_{max}$ reached by cooking utensil 12, and/or food items therein, PTC heating element 24 functions as a passive temperature limiting device and additional components such as, e.g., sensors, relays, electronic controls, and/or thermal switches are not needed to prevent overheating.

Further, in some embodiments, cooktop appliance 10 may incorporate both controller 30, to regulate the temperature or heat output of heating assembly 22 to a selected temperature or heat output, as described above, and PTC heating element 24, to prevent cooking utensil 12 and any food items therein from overheating. Thus, if the temperature of cooking utensil 12 and any food items therein increases beyond the selected temperature and beyond a maximum cooking temperature, despite attempts by controller 30 to regulate the temperature and/or heat output of heating assembly 22, the temperature of PTC heating element 24 is limited, thereby limiting the transfer of heat to cooking utensil 12 and any food items therein. Accordingly, in such embodiments, PTC heating element 24 may act as a secondary control of the temperature reached by cooking utensil 12 and any food items therein.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A heating assembly for a cooktop appliance, the heating assembly configured for placement of a cooking utensil thereon, the heating assembly comprising:

at least one support element, an insulating material, and a positive temperature coefficient heating element, wherein the positive temperature coefficient heating element regulates a temperature of the heating assembly such that a temperature of the cooking utensil placed on the heating assembly does not exceed a maximum temperature, wherein the maximum temperature of the cooking utensil is greater than 325° C. and less than 400° C., and wherein the heating assembly is supported on a cooking surface of the cooktop appliance by the at least one support element such that the at least one support element is vertically located between the heating assembly and the cooking surface and the heating assembly is vertically located between the at least one support element and the cooking utensil placed on the heating assembly.

2. The cooktop appliance of claim 1, wherein the positive temperature coefficient heating element is at least partially surrounded by the insulating material.

3. The cooktop appliance of claim 1, further comprising a sheath surrounding the insulating material.

4. The cooktop appliance of claim 3, wherein the sheath has a semi-circular cross-section and defines a generally flat surface for the placement of the cooking utensil thereon.

5. The cooktop appliance of claim 1, wherein the positive temperature coefficient heating element is made from a material composed of at least 10% Nickel.

6. The cooktop appliance of claim 1, wherein the positive temperature coefficient heating element is made from a semiconductor material.

7. The cooktop appliance of claim 1, wherein the positive temperature coefficient heating element has a temperature coefficient of resistivity greater than about 0.001.

8. The cooktop appliance of claim 1, wherein the positive temperature coefficient heating element has a temperature factor of resistivity greater than about 1.4 at temperatures above 300° C.

9. A cooktop appliance, comprising:

a cooking surface;

a heating assembly, the heating assembly including at least one support element, an insulating material, and a positive temperature coefficient heating element; and a controller in operative communication with the positive temperature coefficient heating element, the controller controlling a temperature of the positive temperature coefficient heating element to a selected temperature that is based on a selection by a user of the cooktop appliance, wherein the positive temperature coefficient heating element regulates a temperature of the heating assembly such that a temperature of a cooking utensil placed on the heating assembly does not exceed a maximum temperature, wherein the maximum temperature is greater than the selected temperature, and wherein the heating assembly is supported on the cooking surface by the at least one support element such that the at least one support element is vertically located between the heating assembly and the cooking surface and the heating assembly is vertically located between the at least one support element and the cooking utensil placed on the heating assembly.

10. The cooktop appliance of claim 9, wherein the positive temperature coefficient heating element is at least partially surrounded by the insulating material.

11. The cooktop appliance of claim 9, wherein the heating assembly further comprises a sheath surrounding the insulating material.

12. The cooktop appliance of claim 11, wherein the sheath has a semi-circular cross-section and defines a generally flat surface for the placement of the cooking utensil thereon.

13. The cooktop appliance of claim 9, wherein the positive temperature coefficient heating element has a temperature coefficient of resistivity greater than about 0.001.

14. The cooktop appliance of claim 9, wherein the positive temperature coefficient heating element has a temperature factor of resistivity greater than about 1.4 at temperatures above 300° C.

15. The cooktop appliance of claim 9, wherein the maximum temperature of the cooking utensil is greater than 325° C. and less than 400° C.

16. The cooktop appliance of claim 9, wherein the heating assembly is coil shaped.

17. The cooktop appliance of claim 9, wherein the cooktop appliance is a radiant cooktop appliance.

18. The cooktop appliance of claim 17, wherein the controller controls the duty cycle of the positive temperature coefficient heating element to regulate the temperature of the heating element based on the user's selection.

19. A cooktop appliance, comprising:

a cooking surface;

a heating assembly, the heating assembly including at least one support element, a positive temperature coefficient heating element, an insulating material surrounding the positive temperature coefficient heating element, and a sheath surrounding the insulating material, the sheath having a semi-circular cross-section and a substantially flat surface for supporting a cooking utensil placed on the heating assembly, wherein the heating assembly is coil shaped and configured for the placement of cooking utensils directly thereon; and a controller in operative communication with the positive temperature coefficient heating element, the controller controlling a temperature of the positive temperature coefficient heating element to a selected temperature that is based on a selection by a user of the cooktop appliance, the controller comprising a memory and a microprocessor, wherein the positive temperature coefficient heating element regulates a temperature of the heating assembly such that a temperature of a cooking utensil placed on the heating assembly does not exceed a maximum temperature, wherein the maximum temperature is greater than the selected temperature, and wherein the heating assembly is supported on the cooking surface by the at least one support element such that the at least one support element is vertically located between the heating assembly and the cooking surface and the heating assembly is vertically located between the at least one support element and the cooking utensil placed on the heating assembly.

20. The cooktop appliance of claim 19, wherein the maximum temperature is greater than 325° C. and less than 400° C.

* * * * *